US006089426A

United States Patent [19]

Brandow et al.

[11] Patent Number: 6,089,426

[45] Date of Patent: Jul. 18, 2000

[54] OPENED SHOTGUN HOLSTER

[75] Inventors: Bruce L. Brandow, Mayvile, N.Y.; Kevin S. Shick; Michael J. Hronas, both of Erie, Pa.

[73] Assignee: Hody Products, Inc., Westfield, N.Y.

[21] Appl. No.: 09/203,095

[22] Filed: Dec. 1, 1998

[51] Int. Cl.[7] ..... A45F 5/00

[52] U.S. Cl. ..... 224/268; 224/272; 224/270; 224/913

[58] Field of Search ..... 224/913, 666, 224/676, 677, 678, 268, 269, 270, 272

[56] References Cited

U.S. PATENT DOCUMENTS

| | | | |
|---|---|---|---|
| D. 162,904 | 4/1951 | Ulvang | 224/913 X |
| 695,176 | 3/1902 | Rumsey | 224/913 X |
| 2,574,143 | 11/1951 | Colby | 224/268 X |
| 2,856,111 | 10/1958 | Wolfe et al. | 224/913 X |
| 3,022,898 | 2/1962 | Loeb | 224/913 X |
| 3,155,297 | 11/1964 | Stumpf | 224/913 X |
| 3,809,349 | 5/1974 | Baedke | 224/268 X |
| 4,977,860 | 12/1990 | Harwell | 224/678 X |
| 5,697,537 | 12/1997 | Bowlsby | 224/268 X |
| 5,775,556 | 7/1998 | Brandow | 224/270 |

*Primary Examiner*—Gregory M. Vidovich
*Attorney, Agent, or Firm*—Frank J. Catalano

[57] ABSTRACT

A holster supports a shotgun in an opened condition at a shooter's side. A pair of rods extend between front and rear walls. The rear wall has a tongue for mounting the holster proximate the shooter's waist. The walls are spaced to receive the pivotally connected barrel and stock portions of the shotgun therebetween so as to prevent the shotgun from sliding off the rods. The rods are spaced by a distance less than the distance between the breach sides of the forearm and the trigger guard of the shotgun in the closed condition and greater than the combined heights of the forearm and the trigger guard so that, when the barrel and stock portions are at rest on the rods, the weight of the barrel portion causes the breach side of the trigger guard to engage against the rod on which the stock portion rests so as to prevent forward rotation of the shotgun off the rods while the weight of the barrel portion prevents rearward rotation of the shogun off the rods. Sleeves can be mounted on the rods to increase the rod diameter to suit a specific shotgun and the angle between the barrel and the stock portions in the shotgun opened condition can be selected in the same manner. Preferably, the rods are spaced and of diameter such that the breach side of the barrel portion engages against the rod on which it rests so as to lock the shotgun in place on the rods.

19 Claims, 4 Drawing Sheets

OPENED SHOTGUN HOLSTER

BACKGROUND OF THE INVENTION

This invention relates generally to sporting equipment and more particularly concerns equipment used in shooting trap, skeet or clay pigeons.

Trap, skeet and clay shooters take great pride in, and often spend considerable sums of money on, their shotguns. They are generally very uncomfortable about leaving their shotguns unattended and loathe to lay them on the ground or against any support that might scratch or damage them. At shooting stations, it is not uncommon to see shooters engaged in rather unique balancing acts, trying to support their shotgun while they adjust their hat, clean or wipe off their glasses or make any other adjustment requiring the use of both hands.

It is, therefore, an object of this invention to provide a shotgun holster which enables the shooter to carry a shotgun in its opened condition without the use of the shooter's hands. Another object of this invention is to provide a shotgun holster which will support an opened shotgun with minimal possibility of scratching or other damage to the surface of the shotgun. It is also an object of this invention to provide a shotgun holster which will support any shotgun used by trap, skeet and clay shooters.

SUMMARY OF THE INVENTION

A shotgun typically has its barrel and stock portions pivotally connected proximate its breach. The underside of the stock portion includes a trigger guard on one side of the breach and the underside of the barrel portion includes a forearm on the other side of the breach. The shotgun is manipulated between a closed or shooting condition in which the barrel and stock portions are in substantially straight alignment and an opened or safety condition in which the barrel and stock portions are in angled alignment. The holster of the present invention is used to support the shotgun in the opened condition at the side of a shooter above the ground.

The holster has a rear wall with a downwardly depending tongue for mounting the holster proximate the waist of the shooter. The tongue may be fastened to the rear wall with a spacer between or molded as part of the rear wall to form a hanger that can be hooked onto the shooter's belt or other article of clothing. A pair of rods extends in perpendicular spaced-apart relationship from the rear wall. The rods are centered on axes which lie in approximately a common horizontal plane. The rods space front walls from the rear wall so that the barrel and stock portions of the opened shotgun, when at rest between the front and rear walls, cannot slide off the rods. The rods are spaced by a distance less than the distance between the breach sides of the forearm and trigger guard when the shotgun is closed and greater than the combined height of the forearm and trigger guard. Thus, when the barrel and stock portions of the opened shotgun are at rest on the rods, the weight of the barrel causes the breach side of the trigger guard to engage against one of the rods and prevent the shotgun from rotating off the rods.

Preferably, the rods are tubular and the front walls are integral with the rods. The integral rods and walls can then be fastened to the rear wall by use of binding screws or the like extending through the tubular rods and apertures provided in the rear wall. It is especially preferred that the rods axes be in a common horizontal plane so that the same holster can be used by both right and left handed shooters, the trigger guard engaging against one rod for right handers and the other rod for left handers. Tests of the holster with a variety of shotguns indicate that a rod spacing of 2.5 to 3 inches for circular rods of 0.50 to 0.55 inches outer diameter is suitable for most shotguns. Furthermore, a pair of sleeves may be used, one mounted on each of the rods, to vary the distance between the contact points of the shotgun on the rods. Sleeves of material suitable to frictionally grip the barrel and stock portions of the shotgun are preferred. A section of flexible PVC tubing has been found suitable for this purpose, preferably of approximately 0.625 inches outer diameter. The diameter of the PVC tubing can be selected not merely to accommodate the particular shotgun used with the holster but also to provide a desired angled relationship between the barrel and stock portions of the shotgun.

BRIEF DESCRIPTION OF THE DRAWINGS

Other objects and advantages of the invention will become apparent upon reading the following detailed description and upon reference to the drawings in which.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE INVENTION

Figure 2:
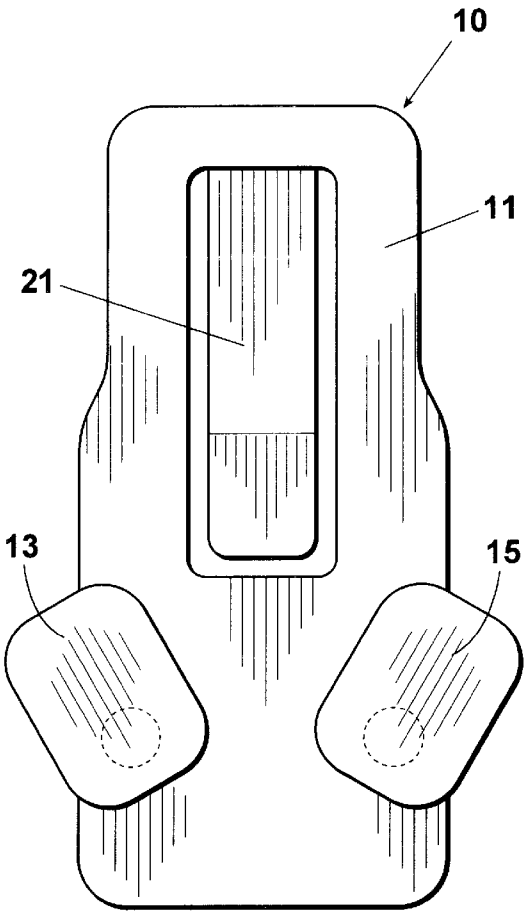
FIG. 2 is a front elevation view of the holster of FIG. 1.
Figure 3:
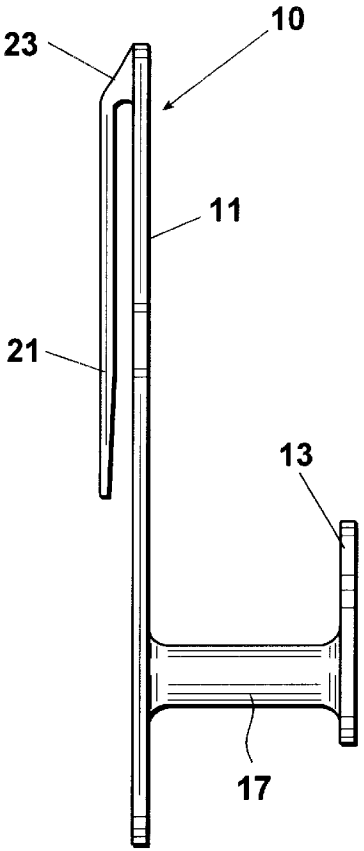
FIG. 3 is a side elevation view of the holster of FIG. 1.
Figure 1:
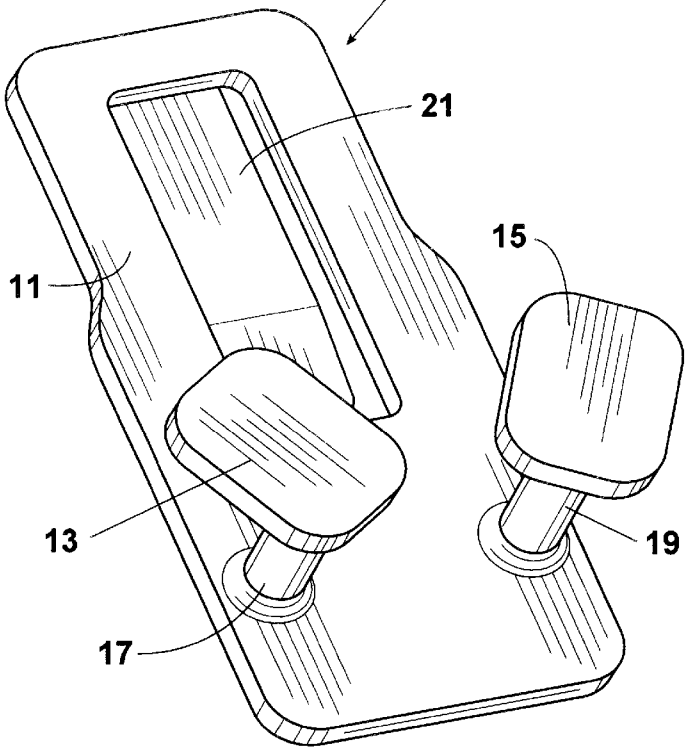
FIG. 1 is a perspective view of the shotgun holster.

A shotgun holster 10 is shown in FIGS. 1, 2 and 3. The holster 10 has a rear vertical wall 11 and front vertical walls 13 and 15 spaced apart by a pair of horizontal rods 17 and 19. A downwardly depending tongue 21 is separated from the rear wall 11 by a spacer 23 disposed between the upper end of the tongue 21 and the upper end of the rear wall 11. The tongue 21, spacer 23 and rear wall 11 may be fastened in laminar relationship by one or more rivets or the like or, as shown, molded in a single piece. The tongue 21 is used to locate the holster 10 in a position approximately at the waist of the shooter (not shown) by insertion of the tongue 21 onto an item of clothing, such as a belt or waistband worn by the shooter. The rods 17 and 19 and front walls 13 and 15, as shown, may be molded in a single piece with the rear wall 11 or may be separately molded.

Figure 4:
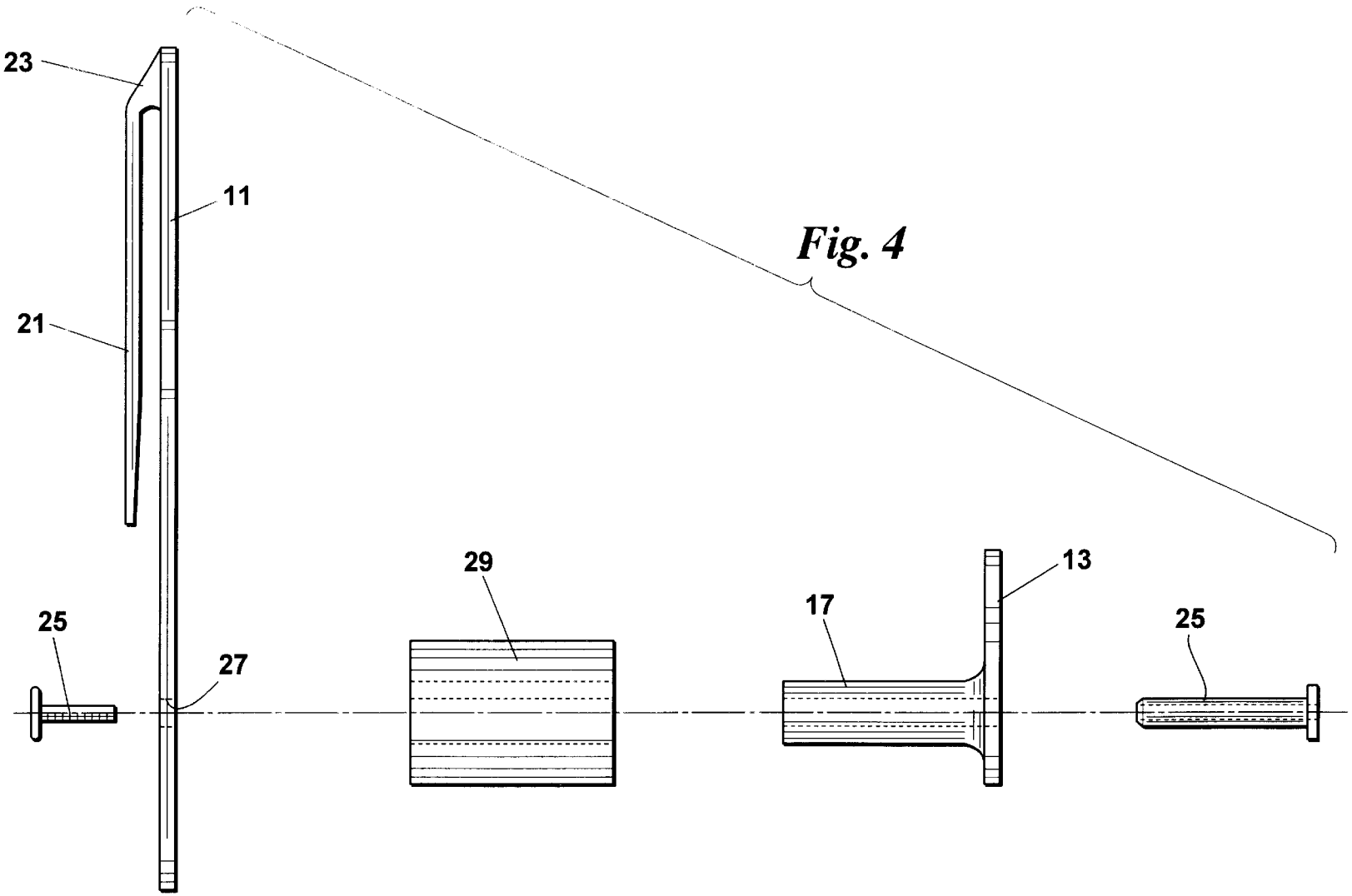
FIG. 4 is a side elevation assembly view of a specially preferred embodiment of the holster of FIG. 1.

In a preferred embodiment of the holster 10 shown in FIG. 4, the rear wall 11, tongue 21 and spacer 23 are molded in a single piece and the front walls 13 and 15 and the rods 17 and 19 are molded in a single piece. The rods 17 and 19 are of tubular cross section. The integral front walls 13 and 15 and rods 17 and 19 are fastened to the rear wall 11 by binding screws 25 which extend through the tubular rods 17 and 19 and apertures 27 in the rear wall 11. Sleeves 29 are preferably slipped over the rods 17 and 19 before the rods 17 and 19 are fastened to the rear wall 11 for reasons hereinafter explained.

Figure 5:
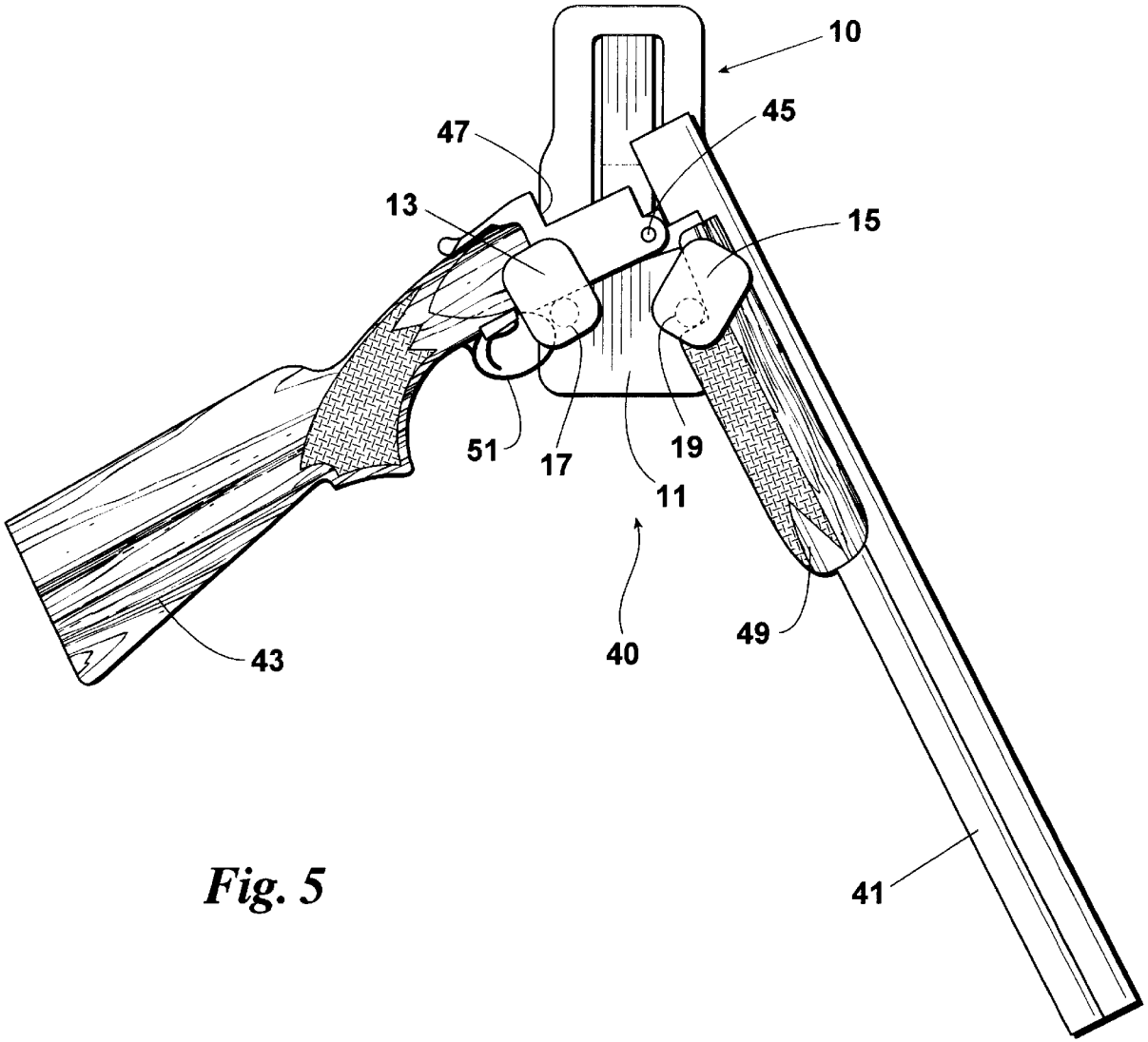
FIG. 5 is a front elevation view of the holster of FIG. 1 with one type of shotgun seated thereon.
Figure 6:
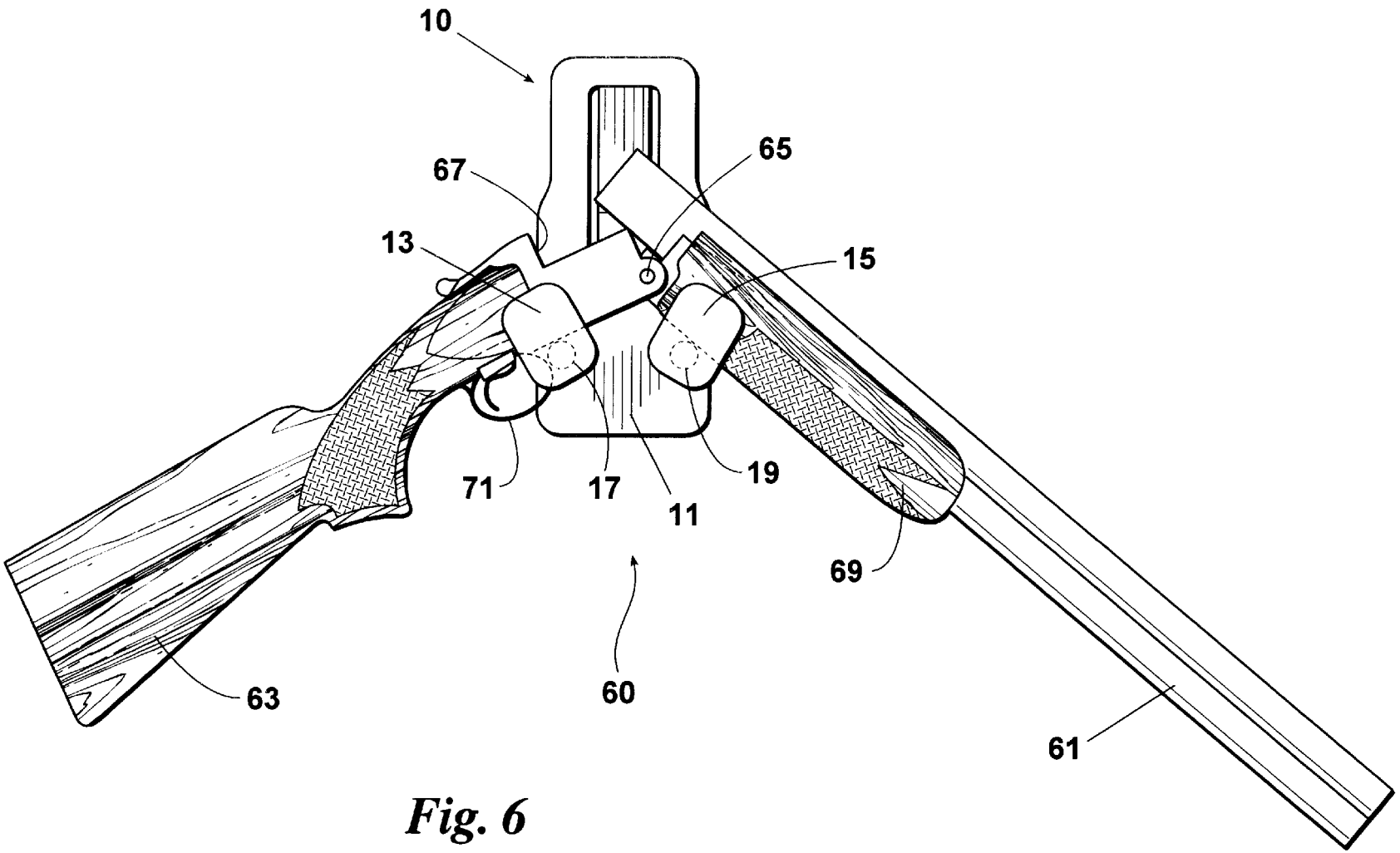
FIG. 6 is a front elevation view of the holster of FIG. 1 with another type of shotgun seated thereon.

Looking now at FIGS. 5 and 6, the configuration and operation of the holster 10 can be best understood in relationship to two different types of shotguns 40 and 60. Both shotguns 40 and 60 have barrel portions 41 and 61 and stock portions 43 and 63 pivotally connected 45 and 65 proximate their breach 47 and 67. The undersides of the barrel portions 41 and 61 have forearms 49 and 69. The undersides of the stock portions 43 and 63 have trigger guards 51 and 71. With the breaches 47 and 67 closed, the barrel portions 41 and 61 and the stock portions 43 and 63 of the shotguns 40 and 60 are in substantially straight alignment and, with the breaches 47 and 67 open, are in angled alignment as shown. The significant difference between the shotguns 40 and 60 is that the forearm 69 of one shotgun 60 is longer and extends closer to the breach 67 than the forearm 49 of the other shotgun 40. However, the same holster 10 can be used to support both shotguns 40 and 60. As shown in FIG. 5, the opened short forearm shotgun 40 is disposed over the rods 17 and 19 of the holster 10 and the underside of the stock portion 43 is engaged on the surface of one rod 17 on the breach side of the trigger guard 51. The barrel portion 41 is engaged on the other rod 19 and the weight of the barrel portion 41 causes the breach side of the trigger guard 51 to also engage against the one rod 17. The front walls 13 and 15 and rear wall 11 prevent the shotgun 40 from sliding off the rods 17 and 19 and the engagement of the trigger guard 51 against the one rod 17 prevents the shotgun 40 from rotating in a forward direction off the rods 17 and 19. In addition, this configuration of the forearm 49 results in the barrel portion 41 engaging on the other rod 19 while the breach side of the forearm 49 also engages against the other rod 19, thus preventing rotation of the shotgun 40 in a rearward direction and firmly locking the shotgun 40 in place on the holster 10.

Looking at FIG. 6, the same cooperation of holster 10 and shotgun 60 occurs except that the longer forearm 69 rests on the other pin 19 and the breach side of the forearm 69 does not engage the other pin 19. Thus one pin 17 prevents forward rotation of the shotgun 60 off the pins 17 and 19 and the weight of the barrel portion 61 is sufficient to assure that the shotgun 60 will not rotate off the pins 17 and 19 in a rearward direction.

As long as the distance between the pins 17 and 19 is less than the distance between the breach sides of the forearms 49 and 69 and the trigger guides 51 and 71, the holster 10 will work effectively. Furthermore, the proper selection and use of sleeves 29 on the rods 17 and 19 will afford the best positioning of and gripping action on the shotgun 40 or 60.

For almost all trap, skeet and clay shotguns, a holster 10 having rods 17 and 19 of approximately two inch length and 0.5 to 0.55 inch outer diameter spaced on 2.5 to 3.0 inch centers and sleeves 29 of approximately 0.625 inch outer diameter polyvinyl chloride tubing will work effectively.

Thus, it is apparent that there has been provided, in accordance with the invention, a shotgun holster that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A combination comprising a shotgun, said shotgun comprising a barrel portion with a forearm on an underside thereof and a stock portion with a trigger guard on the underside thereof pivotally connected proximate a breach of said shotgun to permit manipulation of said shotgun between a closed condition in which said portions are in substantially straight alignment and an opened condition in which said portions are in angled alignment and a holster for supporting said shotgun above the ground in said opened condition at the side of a shooter, said holster comprising a pair of rods extending in spaced-apart relationship between front and rear walls with said rods being centered on axes approximately in a common horizontal plane, said walls being spaced to receive the pivotally connected barrel and stock portions therebetween so as to prevent the shotgun from sliding off said rods, said rear wall having means thereon for mounting said holster proximate the waist of the shooter so as to support said shotgun above the ground, said rods being spaced by a distance less than the distance between breach sides of said forearm and said trigger guard of said shotgun in said closed condition such that said rods are entirely positionable between said forearm and said trigger guard and greater than combined heights of said forearm and said trigger guard so that, when said barrel and stock portions are at rest on said rods, the weight of said barrel portion causes said breach side of said trigger guard to engage against said rod on which said stock portion rests so as to prevent rotation of said shotgun off said rods.

2. A combination according to claim 1, said front and rear walls being vertical and said rods being perpendicular thereto.

3. A combination according to claim 2, said rods being approximately 2 inches in length.

4. A combination according to claim 1, said mounting means comprising a tongue downwardly depending from an upper end of and spaced rearwardly apart from said rear wall for receiving an item of clothing worn by the shooter therebetween.

5. A combination according to claim 1, said rods being tubular.

6. A combination according to claim 5, said front wall comprising two wall portions, one integral with each of said tubular rods.

7. A combination according to claim 1, said rods extending on axes in a common horizontal plane.

8. A combination according to claim 7, said distance between said rods being approximately 2.5 to 3.0 inches.

9. A combination according to claim 1, said rods being of circular cross-section.

10. A combination according to claim 9 further comprising a pair of sleeves, one mounted on each of said rods, of material suitable to frictionally grip said barrel and stock portions of said shotgun.

11. A combination according to claim 10, said sleeves having an outer diameter preselected to provide a desired angled relationship between said barrel and stock portions of said shotgun when said shotgun is seated on said sleeves.

12. A combination according to claim 11, said sleeves having an outer diameter of approximately 0.625 inches.

13. A combination according to claim 10, said sleeves being polyvinyl chloride.

14. A combination according to claim 13, said sleeves having an outer diameter preselected to provide a desired angled relationship between said barrel and stock portions of said shotgun when said shotgun is seated on said sleeves.

15. A combination comprising a shotgun, said shotgun comprising said shotgun comprising a barrel portion with a forearm on an underside thereof and a stock portion with a trigger guard on an underside thereof pivotally connected proximate said shotgun breach to permit manipulation of said shotgun between a closed condition in which said portions are in substantially straight alignment and an opened condition in which said portions are in angled alignment and a holster for supporting said shotgun above the ground in said opened condition at the side of a shooter, said holster comprising a pair of rods extending in spaced-apart relationship between front and rear walls with said rods being centered on axes approximately in a common horizontal plane, said walls being spaced to receive said pivotally connected barrel and stock portions therebetween so as to prevent said shotgun from sliding off said rods, each said rod having an arcuate upper peripheral portion facilitating pivotal rotation of said stock and barrel portions, said rear wall having means thereon for mounting said holster proximate the waist of the shooter so as to support said shotgun above the ground, said rods being spaced by a distance greater than the distance between a breach side of said trigger guard and said pivotal connection so that, when said barrel and stock portions are at rest on said rods with said shotgun is said opened condition, the weight of said barrel portion causes said breach side of said trigger guard to engage against said rod on which said stock portion rests so as to prevent rotation of said shotgun off said rods.

16. For use with a shotgun having a barrel portion with a forearm on an underside thereof and a stock portion with a trigger guard on an underside thereof pivotally connected proximate a breach of the shotgun to permit manipulation of the shotgun between a closed condition in which the portions are in substantially straight alignment and an opened condition in which the portions are in angled alignment, a holster for supporting the shotgun above the ground in the opened condition at the side of a shooter, the holster comprising a pair of rods extending in spaced-apart relationship between front and rear walls with said rods being centered on axes approximately in a common horizontal plane, said front wall comprising two wall portions, one integral with each of said tubular rods, said rear wall having apertures therethrough and being fastened to said tubular rods by use of binding screws respectively extending through said tubular rods and said apertures, said front walls being spaced from said rear to receive the pivotally connected barrel and stock portions therebetween so as to prevent the shotgun from sliding off said rods, said rear wall having means thereon for mounting said holster proximate the waist of the shooter so as to support the shotgun above the ground, said rods being spaced by a distance so that, when the barrel and stock portions are at rest on said rods, the weight of the barrel portion causes the breach side of the trigger guard to engage against said rod on which the stock portion rests so as to prevent rotation of the shotgun off said rods.

17. A holster according to claim 16, said distance between said rods being approximatley 2.5 to 3.0 inches.

18. A holster according to claim 16, said rods being of circular cross-section.

19. A holster according to claim 18 further comprising a pair of sleeves, one mounted on each of said rods, of material suitable to frictionally grip the barrel and stock portions of the shotgun.

* * * * *